US005462557A

United States Patent [19]

Jordan et al.

[11] Patent Number: 5,462,557

[45] Date of Patent: Oct. 31, 1995

[54] DISC-TYPE DEPILATION APPARATUS WITH FORCE TRANSMISSION STUDS

[75] Inventors: Hermann Jordan; Erich Krammer; Johann T. Rogatschnig, all of Klagenfurt, Austria; Petronella H. Den Ouden; Francis J. Span, both of Eindhoven, Netherlands

[73] Assignee: U.S. Philips Corporation, New York, N.Y.

[21] Appl. No.: 175,697

[22] Filed: Jan. 3, 1994

Related U.S. Application Data

[63] Continuation of Ser. No. 941,470, Sep. 8, 1992, abandoned.

[30] Foreign Application Priority Data

Sep. 10, 1991 [EP] European Pat. Off. ..... 91202301

[51] Int. Cl.[6] ..... A45D 26/00

[52] U.S. Cl. ..... 606/133; 606/131

[58] Field of Search ..... 606/131, 133; 452/71, 82–88, 99–102

[56] References Cited

U.S. PATENT DOCUMENTS

| | | | |
|---|---|---|---|
| 1,875,980 | 9/1932 | Bingham . | |
| 1,923,415 | 8/1933 | Bingham | 17/11 |
| 2,788,651 | 4/1957 | Qwarnstrom | 69/20 |
| 2,900,661 | 8/1959 | Schnell | 17/11.1 |
| 3,468,141 | 9/1969 | Soleanicov et al. | 69/20 |
| 3,608,153 | 9/1971 | Berrett | 19/2 |
| 3,911,530 | 10/1975 | Kalfsbeck et al. | 17/11.1 |
| 4,079,741 | 3/1978 | Daar et al. . | |
| 4,279,253 | 7/1981 | Haes et al. . | |
| 4,575,902 | 3/1986 | Alazet | 19/2 |
| 4,726,375 | 2/1988 | Gross et al. . | |
| 4,807,624 | 2/1989 | Gross et al. . | |
| 4,830,004 | 5/1989 | Alazet . | |
| 4,935,024 | 6/1990 | Dolev | 606/133 |
| 4,960,422 | 10/1990 | Demeester | 606/133 |
| 5,171,315 | 12/1992 | Cabrero | 606/131 |
| 5,190,559 | 3/1993 | Gabion et al. | 606/133 |
| 5,196,021 | 3/1993 | Kabla | 606/133 |
| 5,197,969 | 3/1993 | Visscher et al. | 606/133 |
| 5,281,233 | 1/1994 | Doley | 606/133 |

FOREIGN PATENT DOCUMENTS

| | | |
|---|---|---|
| 788130 | 10/1935 | France . |
| 943472 | 3/1949 | France . |
| 2556939 | 6/1985 | France . |
| 1121291 | 1/1962 | Germany . |
| 420470 | 6/1936 | United Kingdom . |
| 461572 | 2/1937 | United Kingdom . |

*Primary Examiner*—Stephen C. Pellegrino
*Assistant Examiner*—Glenn Dawson
*Attorney, Agent, or Firm*—Ernestine C. Bartlett

[57] ABSTRACT

A depilation apparatus including a number of pinching discs (35) which are coupled to a drive shaft (7) in positions which are mutually rotated through 120° about the drive shaft (7) is provided. Each pair of adjoining pinching discs (35) is pivotable under the influence of a compression member (83) into a pinching position in which two cooperating pinching surfaces (67, 63) exert a pinching force on one another. The pivot axis (113) of each pair of pinching discs (35) is determined by a stud part (**55*b*) of a bipartite stud (55) of one of the two pinching discs (35) and by the mutually facing steps (41) of the two pinching discs (35). The cooperating pinching surfaces (67, 63) are supported on either side in the pinching position by the stud parts (55*b*) and (55*a*), respectively, of the bipartite studs (55) of the adjoining pinching discs (35), so that a substantially straight force transmission path is created in the pinching position. Each pair of cooperating pinching discs is provided with a delaying stud (59) by which the pinching position is temporarily delayed after tilting of the pinching discs (35) about the pivot axis (113). Furthermore, each pair of cooperating pinching surfaces (67, 63) is provided with two nose-shaped combs (73, 71**) which are bent into a hair-trapping funnel.

24 Claims, 9 Drawing Sheets

DISC-TYPE DEPILATION APPARATUS WITH FORCE TRANSMISSION STUDS

This is a continuation of application Ser. No. 07/941,470, filed Sep. 8, 1992, now abandoned.

FIELD OF THE INVENTION

The invention relates to a depilation apparatus with pinching discs which are coupled to a drive shaft which is rotatable relative to a housing and extends parallel to a depilation opening of the housing, and which are each pivotable under the influence of a compression means relative to each adjoining pinching disc about a pivot axis directed transverse to the drive shaft into a pinching position in which a pinching surface of the pinching disc and a pinching surface of the relevant adjoining pinching disc exert a pinching force on one another near the depilation opening, the pivot axis of each pair of adjacent pinching discs being determined by two pivot studs which are provided on a lateral surface of at least one of the pinching discs of the pair.

1. Background of the Invention

A depilation apparatus of the kind mentioned in the opening paragraph, which is suitable for plucking chicken feathers and down, is known from U.S. Pat. No. 1,923,415. The pinching discs of the known depilation apparatus are substantially identical, each comprising a first lateral surface having two diametrically opposed pivot studs and two diametrically opposed pinching surfaces, the pinching surfaces being situated on a centerline of the pinching disc which encloses an angle of 90° with a further centerline on which the pivot studs are situated. Two diametrically opposed support surfaces are present on a second lateral surface of the pinching discs on a centerline which encloses an angle of 45° with the said centerline of the pivot studs. The pinching discs are coupled to the drive shaft in consecutive positions which are mutually rotated about the drive shaft through angles of 45°, so that the two pivot studs of each pinching disc bear on the support surfaces of an adjoining pinching disc. The compression means of the known depilation apparatus comprises two pressure rollers which each bear on the outward-facing lateral surface of one of the two outermost pinching discs near the depilation opening under the load of a mechanical spring. During a full revolution of the drive shaft, each pair of adjacent pinching discs is twice pivoted about the relevant pivot studs under the influence of the compression means, whereby the two pinching surfaces of the first lateral surface of each pinching disc come into contact alternately with the pinching disc adjoining the first lateral surface near the depilation opening, while each pinching disc comes into contact alternately with both adjoining pinching discs. During this, the pinching discs exert a pinching force on one another whose value is determined by the compression member. In this manner any chicken feathers present in the depilation opening are pinched between the pinching discs and plucked from the skin through the rotation of the drive shaft.

A disadvantage of the known depilation apparatus is that the compression means causes a bending torque in the pinching discs, under the influence of which the pinching discs are elastically deformed owing to their small bending stiffness. The pinching force between the pinching discs is adversely affected by this.

2. Summary of the Invention

An object of the invention is to provide a depilation apparatus of the kind mentioned in the opening paragraph in which the bending torque caused by the compression means in the pinching discs is avoided as much as possible, so that a greater pinching force between the pinching discs and a better operation of the depilation apparatus are achieved.

According to the invention, the depilation apparatus is for this purpose characterized in that each pinching disc which is in the pinching position in conjunction with one of the two adjoining pinching discs is supported near the relevant pinching surface by the other adjoining pinching disc by means of a force transmission stud. Since each pinching disc is supported in the pinching position near the relevant pinching surface by means of a force transmission stud, a substantially straight force transmission path is provided near the depilation opening, so that only a comparatively small bending torque is caused in the pinching discs near the depilation opening and only a very slight deformation of the pinching discs takes place.

A special embodiment of the depilation apparatus according to the invention is characterized in that the two outermost pinching discs are each provided with a stiffening plate at a lateral surface facing away from the adjoining pinching disc, the compression means exerting a compression force directed substantially parallel to the drive shaft on each of the two stiffening plates near the depilation opening in the pinching position of the pinching discs. Owing to the use of the stiffening plates, the compression force exerted on the two outermost pinching discs by the compression means is transmitted to the relevant force transmission studs in a stable manner.

A further embodiment of the depilation apparatus according to the invention, which provides a compression means of simple construction and low wear, while the compression member is provided with a first and a second roller means each of which lies against one of the two stiffening plates near the depilation opening, is characterized in that the first roller member has its rotation bearings in the housing while the second roller member has its rotation beatings in a pressure head which is movable relative to the housing substantially parallel to the drive shaft under spring pressure of a mechanical spring fastened between the pressure head and the housing.

A yet further embodiment of the depilation apparatus according to the invention is characterized in that the housing is provided with a stop for the pressure head by means of which a minimum interspacing between the two roller members is defined. The use of the stop prevents an undesired compression of the pinching discs in an intermediate position of the pinching discs, in which position none of the pinching discs is in the pinching position and no force transmission studs are present near the depilation opening.

A particular embodiment of the depilation apparatus according to the invention is characterized in that each pinching disc situated between two adjoining pinching discs is provided on each lateral surface with only one pinching surface, the two pinching surfaces being situated on centerlines of the pinching disc which enclose an angle of substantially 120° with one another, while the pinching disc is provided with two force transmission studs which are each on a centerline which encloses an angle of substantially 120° with the centerline of a respective pinching surface, the pinching discs being coupled to the drive shaft in consecutive positions which are rotated about the drive shaft through mutual angles of 120°. In this embodiment each pinching disc situated between two adjoining pinching discs is supported in the pinching position by an adjoining pinching disc which is not in the pinching position by means of a force transmission stud, so that a reduction in the distance between the two outermost pinching discs caused by pivoting of the pinching discs near the depilation opening is restricted.

A further embodiment of the depilation apparatus according to the invention is characterized in that the cooperating pinching surfaces of each pair of adjacent pinching discs are present on a centerline which encloses an angle of substantially 60° with the pivot axis of the pair, one of the two force transmission studs of each pinching disc being integral with one of the two pivot studs of the relevant pinching disc. The use of the said angle of 60° achieves a maximum value for the pinching force exerted by the cooperating pinching surfaces on one another after a comparatively short period whenever the pinching discs have pivoted towards the pinching position. In addition, it provides a simple construction of the pinching discs.

A yet further embodiment of the depilation apparatus according to the invention is characterized in that the two force transmission studs are each situated on a respective lateral surface of the pinching disc on a joint centerline which encloses an angle of substantially 120° with the centerline of each of the two pinching surfaces. In this embodiment, the two adjoining pinching discs of the relevant pinching disc are simultaneously supported in their pinching positions each by one of the two force transmission studs which have been provided in the same positions relative to the center of the relevant pinching disc. A particularly stable transmission of the pinching force is provided in this way.

A special embodiment of the depilation apparatus according to the invention, which renders possible a choice from a wide range of materials for the force transmission studs, is characterized in that the two force transmission studs are integrated so as to form a bipartite stud which is provided in a stud window of the pinching disc.

A further embodiment of the depilation apparatus according to the invention is characterized in that the bipartite stud is fastened to the pinching disc by means of a flexible strip which extends in a radial direction relative to the center of the pinching disc in the stud window of the pinching disc. The use of the flexible strip renders small displacements of the bipartite stud relative to the pinching disc possible. Shifts of the bipartite stud over the two adjoining pinching discs are prevented by this, which shifts could arise as a result of small differences in velocity between the pinching discs during the support action of the two adjoining pinching discs, and which lead to wear of the studs.

A yet further embodiment of the depilation apparatus according to the invention, in which wear of the force transmission studs as a result of differences in velocity between the pinching discs is prevented, is characterized in that each pinching disc positioned between two other pinching discs is coupled to the drive shaft by means of a hub which is fastened to the pinching disc via an elastically deformable coupling member. The use of the said coupling member renders small displacements of the pinching disc relative to the hub possible.

A particular embodiment of the depilation apparatus according to the invention, which provides a practical construction of the coupling member between the pinching disc and the hub, is characterized in that the coupling member comprises two flexible spokes which extend transversely to one another in a central window of the pinching disc.

A further embodiment of the depilation apparatus according to the invention, which provides a simple construction of the pinching discs, is characterized in that one of the two pivot studs of each pinching disc is formed by a hub positioned near the center of the pinching disc, with which hub the pinching disc is coupled to the drive shaft and bears on an adjoining pinching disc.

A still further embodiment of the depilation apparatus according to the invention is characterized in that one of the lateral surfaces of each pair of adjoining pinching discs is provided with a single delaying stud which is situated on a centerline which encloses an angle smaller than 60° with the centerline on which the cooperating pinching surfaces of the pair are present. The delaying stud keeps the pinching discs of the pair temporarily away from one another after they have tilted about the pivot axis, so that the pinching discs do not immediately enter the pinching position. Thus a trapping space remains present between the cooperating pinching surfaces of the pair for a longer period.

A special embodiment of the depilation apparatus according to the invention is characterized in that each pinching disc situated between two adjoining pinching discs is provided with two recesses near a circumference, each recess being provided in front of a respective pinching surface of the two pinching surfaces of the pinching disc seen in a direction of rotation of the pinching disc, while a portion of each pinching surface adjoining the said recess is constructed as a nose-shaped comb. The use of the said recesses in conjunction with the nose-shaped combs results in that hairs present in the depilation opening are combed into a direction transverse to the drive shaft, so that also hairs directed parallel to the drive shaft can be clamped between the pinching discs.

A further embodiment of the depilation apparatus according to the invention is characterized in that the nose-shaped combs of the cooperating pinching surfaces of each pair of adjoining pinching discs are bent so as to form a hair-trapping funnel. The use of the hair-trapping funnel formed by the two combs, which precedes the pinching surfaces seen in the direction of rotation of the pinching discs, increases the hair-trapping range of the pinching discs.

A yet further embodiment of the depilation apparatus according to the invention, in which an undesirable pinching of the skin between the nose-shaped combs is counteracted, is characterized in that the pinching discs have a radius of reduced size near each nose-shaped comb.

A further embodiment of the depilation apparatus according to the invention, in which the catching probability for comparatively short hairs is increased, is characterized in that the pinching discs have an increased radius near each pinching surface.

BRIEF DESCRIPTION OF THE DRAWINGS

The invention will be explained in more detail below with reference to a drawing in which.

DETAILED DESCRIPTION OF THE PREFERRED EMBODIMENTS

Figure 1:
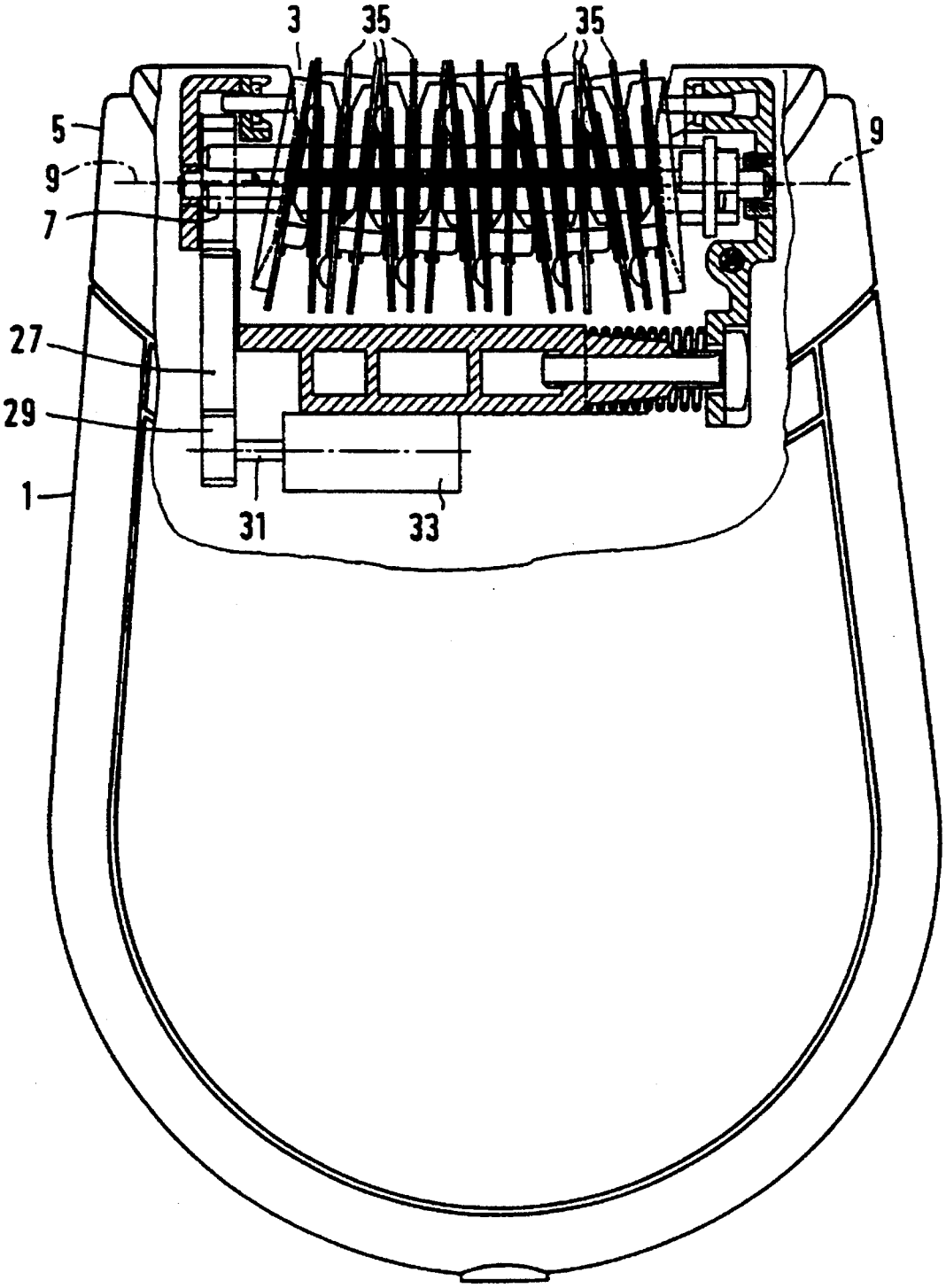
FIG. 1 is a perspective side elevation of an embodiment of a depilation apparatus according to the invention in which a depilation head of the depilation apparatus is visible.
Figure 2:
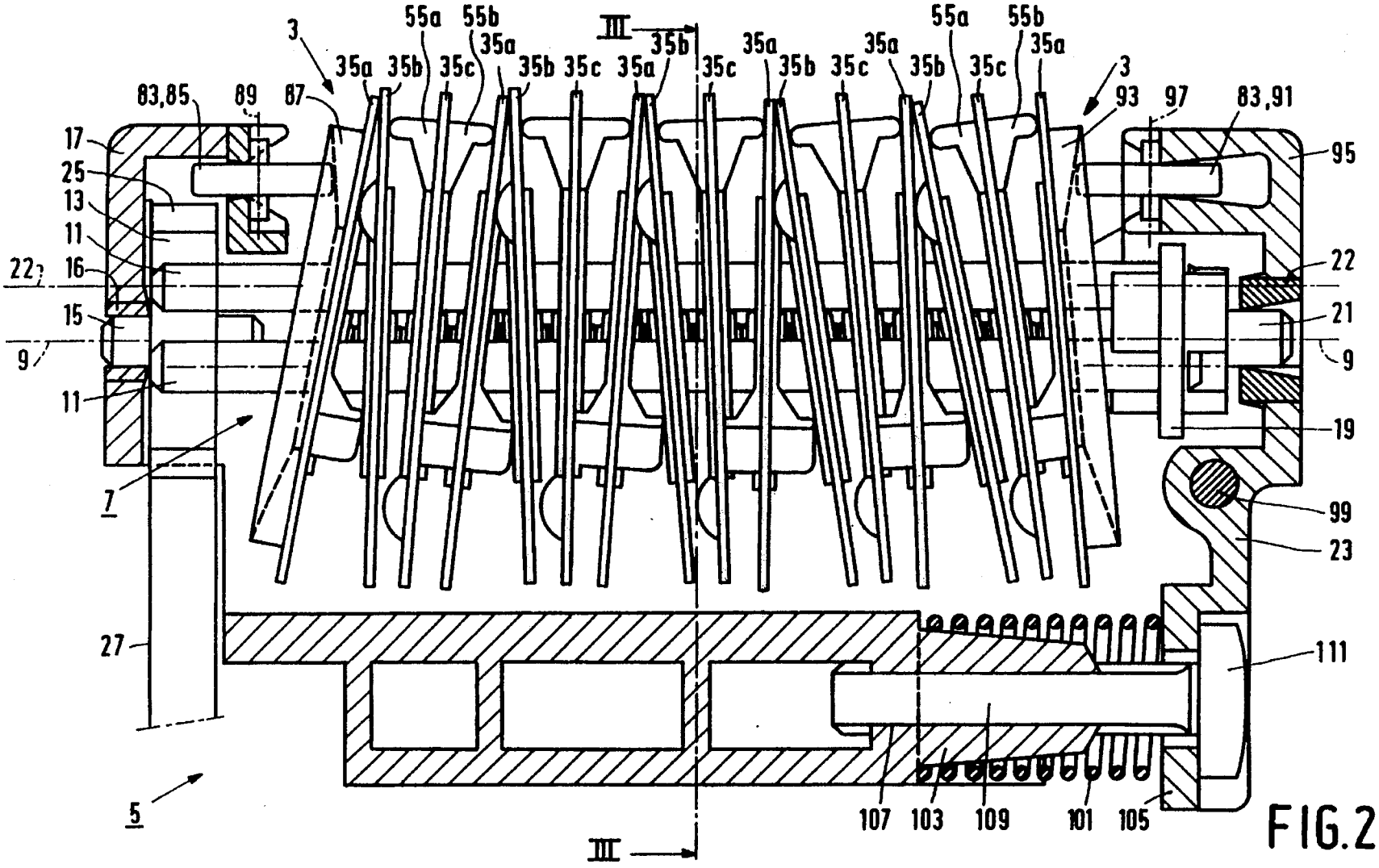
FIG. 2 shows the depilation head of the depilation apparatus according to FIG. 1 in detail.
Figure 3:
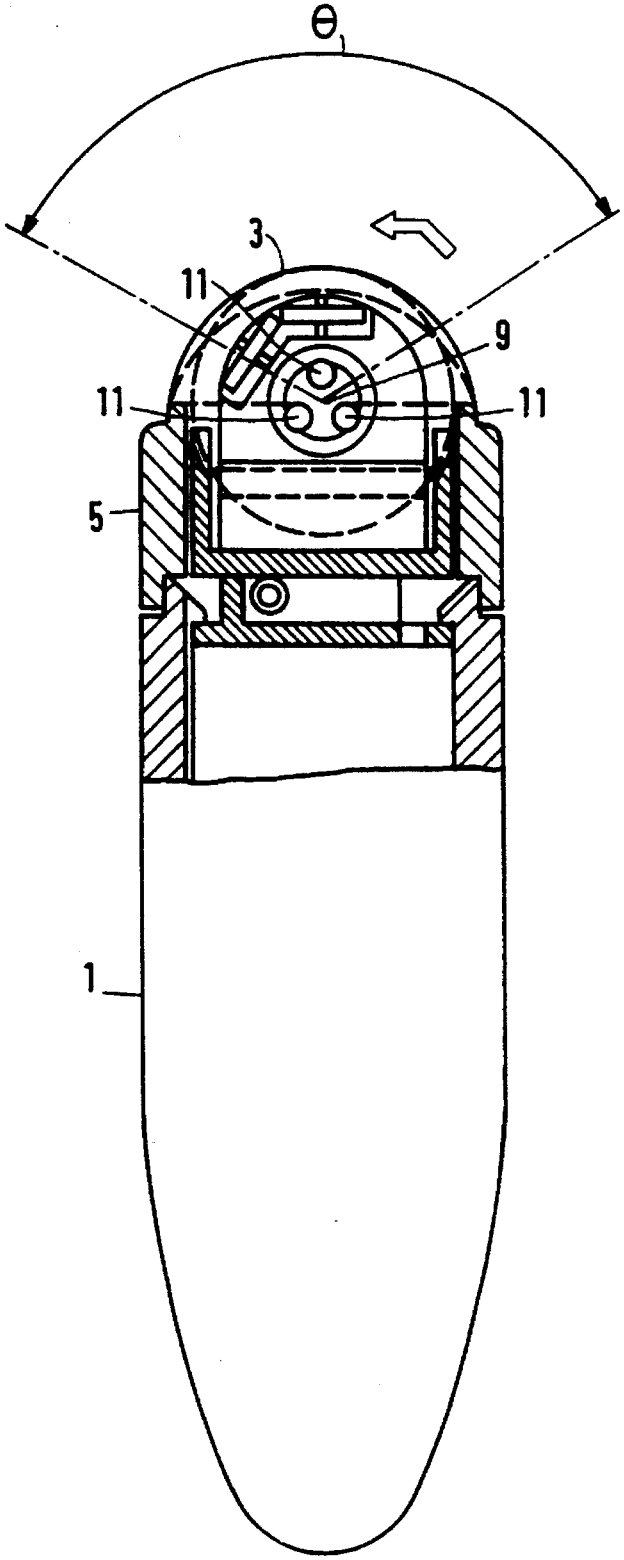
FIG. 3 is a cross-section of a drive shaft of the depilation head taken on the line III—III in FIG. 2.

The embodiment of the depilation apparatus according to the invention shown in FIGS. 1 to 5 comprises with a housing 1 with a depilation opening 3 provided in a depilation head 5 of the housing 1. As is shown in FIGS. 1 and 2, a drive shaft 7 with a centerline 9 extending parallel to the depilation opening 3 is present in the depilation head 5. The drive shaft 7 is provided with three parallel round metal rods 11 which are arranged in an equilateral triangle seen in a plane perpendicular to the centerline 9, the point of intersection of the centerline 9 with the said plane being situated near the center of gravity of the triangle (see FIG. 3). As is shown in detail in FIG. 2, the two ends of each of the three rods 11 are fastened to a first mounting disc 13 which can rotate by means of a journal 15 in a bearing bush 16 of a first bearing support 17 of the housing 1, and a second mounting disc 19 which can rotate by means of a journal 21 in a bearing bush 22 of a second bearing support 23 of the housing 1, respectively. The first mounting disc 13 is provided with a toothed rim 25 which is in engagement with a toothed belt 27. As FIG. 1 shows, the toothed belt 27 is furthermore in engagement with a gearwheel 29 which is fastened to an output shaft 31 of an electric drive motor 33 arranged in the housing 1, by means of which the drive shaft 7 can be rotated.

As FIGS. 1 and 2 show, the depilation apparatus is further provided with a number of pinching discs 35 made preferably of metal which are coupled to the drive shaft 7 so as to rotate along with the latter and are identical except for the two outermost pinching discs 35*a*. Each pair of adjoining pinching discs (35*a*, 35*b*), (35*b*, 35*c*) and (35*c*, 35*a*) is pivotable in a manner yet to be described below about a pivot axis directed transverse to the centerline 9 of the drive shaft 7 into a pinching position in which the two pinching discs 35 of the relevant pair exert a pinching force on one another near the depilation opening 3. In the position of the drive shaft 7 depicted in FIG. 2, the pairs (35*a*, 35*b*) are in the pinching position, whereby hairs clamped between the pinching discs 35*a* and 35*b* are pulled from the skin exposed to the pinching discs 35 through the depilation opening 3 owing to the rotation of the drive shaft 7. When the drive shaft 7 rotates further, as will be explained further below, the pairs (35*b*, 35*c*) and the pairs (35*c*, 35*a*) will enter the pinching position consecutively, upon which the pairs (35*a*, 35*b*) again enter the pinching position after one full revolution of the drive shaft 7.

Figure 4A:
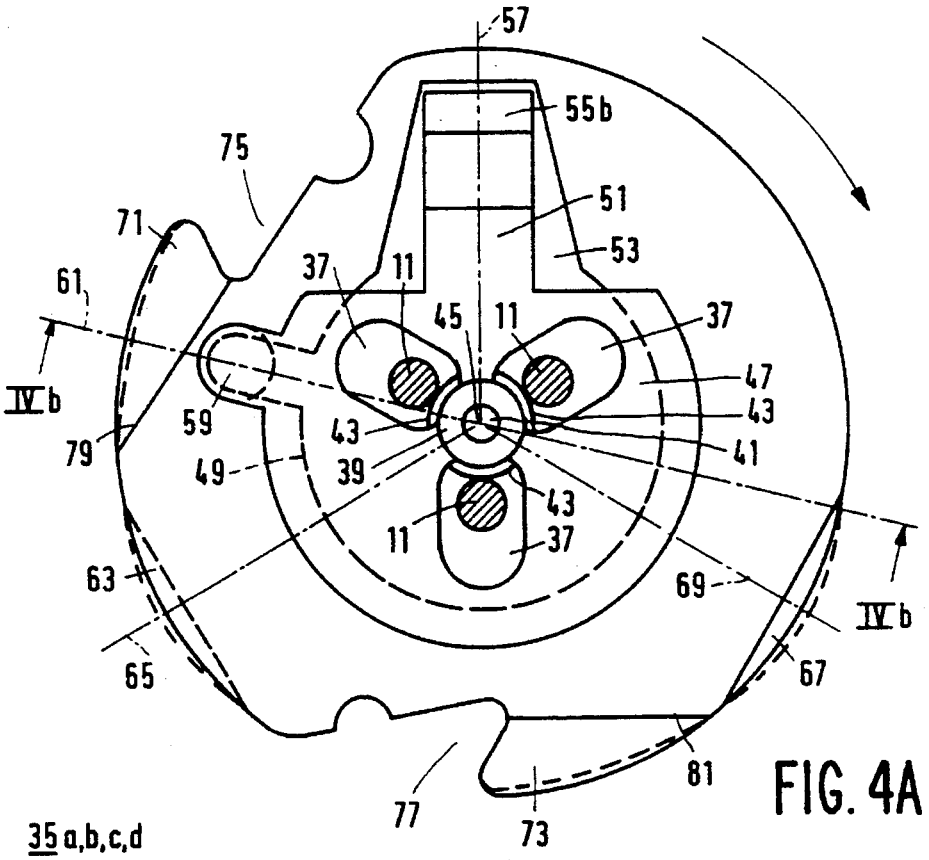
FIG. 4*a* shows a first embodiment of a pinching disc of the depilation head of FIG. 2.
Figure 4B:
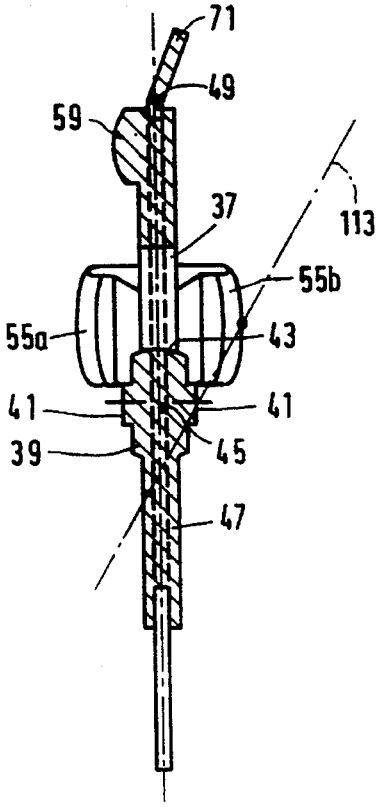
FIG. 4*b* shows a cross-section of the pinching disc taken on the line IVb— IVb in FIG. 4*a*.

FIGS. 4*a* and 4*b* show a first embodiment of a pinching disc 35 having three oval windows 37 which are arranged around a central, partly spherical hub 39. It is visible from FIG. 4*b* that the hub 39 is provided with a projecting step 41 on either side of the pinching disc 35, while the lateral surfaces 43 of the pivot hub 39 adjoining the windows 37 each form part of a spherical surface whose center coincides with the center 45 of the pinching disc 35. The hub 39 lies with its lateral surfaces 43 against the three rods 11 of the drive shaft 7, which rods are depicted in cross-section in FIG. 4*a*. The other parts of the windows 37 are provided around the rods 11 with clearance. Owing to the use of the spherical hub 39, the pinching disc 35 is enclosed between the rods 11 in radial directions relative to the centerline 9 substantially without play. During rotation of the drive shaft 7, at least one of the rods 11 bears on an edge of the relevant window 37, while a pivoting movement of the pinching disc 35 about a pivot axis transverse to the centerline 9 is rendered possible by the said clearance of the windows 37 around the rods 11.

As is shown in FIG. 4*a*, the windows 37 are provided in a core disc 47 of synthetic resin which at the same time comprises the hub 39 and which is fastened in a central window 49 of the pinching disc 35. The core disc 47 is also provided with a flexible strip 51 which is accommodated with clearance in a stud window 53 of the pinching disc 35 adjoining the central window 49 and which extends in a radial direction relative to the center 45. The flexible strip 51 is provided near its end with a bipartite stud 55 whose two stud parts 55*a* and 55*b* are arranged on either side of the pinching disc 35 (see FIG. 4*b*). The flexible strip 51 is elastically deformable in a direction transverse to the plane of the pinching disc 35, so that the bipartite stud 55 is displaceable in the said direction relative to the pinching disc 35 and can be twisted through a limited angle about a twisting axis which substantially coincides with a radius 57 of the pinching disc 35 running through the center of the flexible strip 51. The core disc 47 is further provided at one side with a single stud 59 (a delaying stud) (see FIG. 4*b*) which is situated on a radius 61 of the pinching disc 35 enclosing an angle of 75° with the radius 57 on which the bipartite stud 55 is situated. It is noted that the core disc 47 of synthetic resin with the hub 39, the flexible strip 51, the bipartite stud 55 and the single stud 59 form one integral injection-moulded part of the pinching disc 35.

As FIG. 4*a* further shows, the pinching disc 35 is provided with a first metal pinching surface 63 which is present on the same lateral surface of the pinching disc 35 as the single delaying stud 59 and which is situated symmetrically relative to a radius 65 of the pinching disc 35 which encloses angles of 120° and 45° with the radii 57 and 61, respectively. On the other lateral surface of the pinching disc 35, there is a second metal pinching surface 67 which is situated symmetrically relative to a radius 69 of the pinching disc 35 which encloses angles of 120° with the radii 57 and 65. Seen in a direction of rotation of the pinching disc 35 indicated in FIG. 4*a*, a first nose-shaped comb 71 and a second nose-shaped comb 73 are arranged in front of the pinching surfaces 63 and 67, respectively, which combs adjoin a first and a second recess 75 and 77, respectively, provided near a circumference of the pinching disc 35. The combs 71 and 73 are bent about respective bending lines 79 and 81 in directions away from the respective pinching surfaces 63 and 67. The bent comb 71 is visible in cross-section in FIG. 4*b*. The comb 73 is bent in the opposite direction.

As FIG. 2 shows, each pinching disc 35 rests with its two steps 41 against the steps 41 of the adjoining pinching discs 35. The pinching discs 35 are thereby held together as a set by means of a compression means 83 with a first roller member 85, which near the depilation opening 3 bears on a stiffening plate 87 of the outermost pinching disc 35*a* situated near the first mounting disc 13. The roller member 85 has its rotation beatings in the first bearing support 17 of the housing 1 with an axis of rotation 89 directed transverse to the centerline 9. A second roller member 91 of the compression means 83 bears on a stiffening plate 93 of the outermost pinching disc 35*a* situated near the second mounting disc 19 near the depilation opening 3 and has its rotation bearings in a pressure head 95 with an axis of rotation 97 directed transverse to the centerline 9. The pressure head 95 is integral with the second bearing support 23 and is rotatable together with the second bearing support 23 about a rotation pin 99 shown in cross-section in FIG. 2 which is fastened to the housing 1 and extends transverse to the centerline 9. The second roller member 91 is pressed against the stiffening plate 93 under the influence of a pre-tensioned mechanical helical spring 101 which is arranged at a side of the drive shaft 7 remote from the depilation opening 3 and which bears with one of its ends against a spring holder 103 of the housing 1 and with its other end on an arm 105 of the second bearing support 23. The spring holder 103 is further provided with a drilled hole 107 into which an adjustment bolt 109 is screwed. A head 111 of the adjustment bolt 109 is present at a side of the arm 105 remote from the helical spring 101 and forms a stop for the rotatable bearing support 23. The function of this stop, by which a minimum distance between the two roller members 85 and 91 is safeguarded, is further explained below. The pressure head 95 is displaceable substantially parallel to the drive shaft 7 under rotation of the bearing support 23 about the rotation pin 99, whereby a shifting of the journal 21 in the bearing bush 22 of the second bearing support 23 takes place. It is noted that, instead of each of the roller members 85 and 91, a ball bearing may alternatively be used, in which case the stiffening plates 87 and 93 are each rotatable relative to a bearing plate by the use of a rim of balls between the stiffening plate 87, 93 and the bearing plate.

Figure 5:
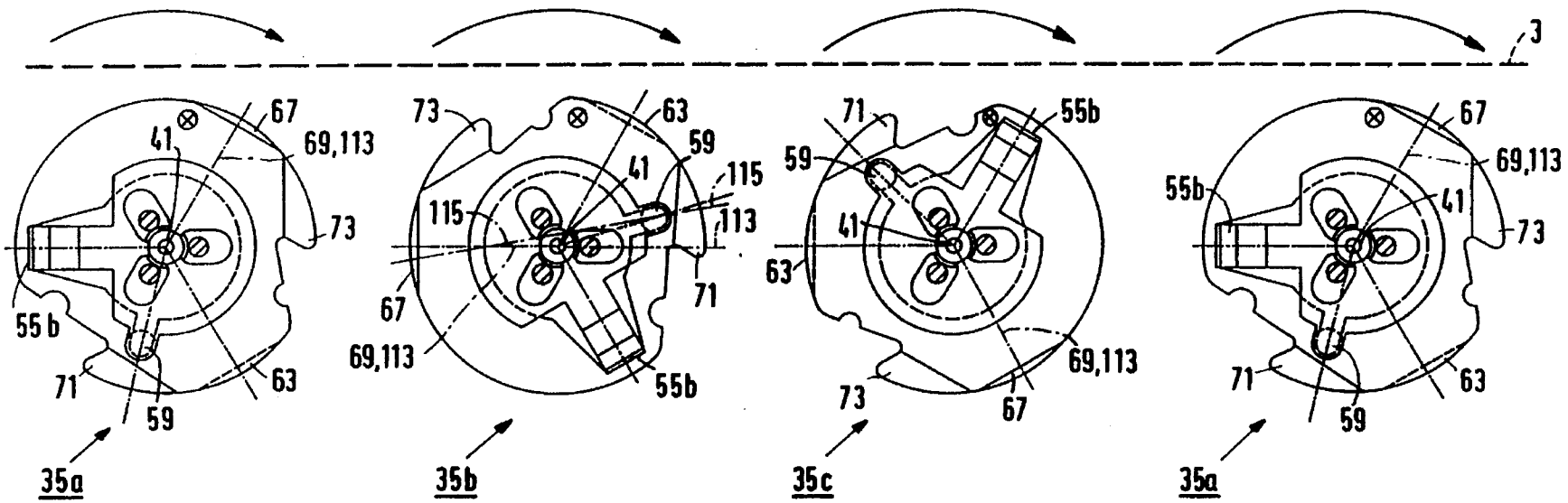
FIG. 5 shows the mutual positions of four consecutive pinching discs of the depilation head of FIG. 2.

FIG. 5 shows four consecutive pinching discs 35 coupled to the drive shaft 7. The single delaying studs 59 of the pinching discs 35 are directed towards the first mounting disc 13 of the drive shaft 7. It is visible in this Figure that the positions in which the consecutive pinching discs 35 are coupled to the drive shaft 7 are mutually rotated through an angle of 120°. Thus the second pinching surface 67 of each pinching disc **35*a* and the first pinching surface 63 of the adjoining pinching disc 35*b* form a pair of cooperating pinching surfaces 67, 63 in which the second nose-shaped comb 73 of the pinching disc 35*a* and the first nose-shaped comb 71 of the adjoining pinching disc 35*b* form a hair-trapping funnel which, seen in the direction of rotation of the pinching discs 35, precedes the pair of cooperating pinching surfaces 67, 63. Similarly, the second pinching surface 67 of each pinching disc 35*b* and the first pinching surface 63 of the adjoining pinching disc 35*c* form a pair of cooperating pinching surfaces 67, 63, while again the second pinching surface 67 of each pinching disc 35*c* together with the first pinching surface 63 of the adjoining pinching disc 35*a* forms a pair of cooperating pinching surfaces 67, 63. Thus each pinching disc 35, excepting the two outermost pinching discs 35*a*, is in cooperation with both its adjoining pinching discs 35**.

FIG. 5 further shows that the point of contact by which the stud part **55*b* of each pinching disc 35*a* bears on the adjoining pinching disc 35*b* together with the point of contact of the abutting steps 41 of the pinching discs 35*a* and 35*b* defines a pivot axis 113 of the pair of cooperating pinching discs 35*a*, 35*b* which in projection substantially coincides with the radius 69 on which the second pinching surface 67 of the pinching disc 35*b* is situated. To clarify this, the pivot axis 113 is also shown for the pinching disc 35*a* depicted in cross-section in FIG. 4*b*. The point of contact of the stud part 55*b* of each pinching disc 35*b* and the point of contact of the abutting steps 41 of the pinching discs 35*b* and 35*c* thus also define a pivot axis 113 of the pair of cooperating pinching discs 35*b*, 35*c*, which in projection substantially coincides with the radius 69 on which the second pinching surface 67 of the pinching disc 35*c* is situated. The point of contact of the stud pan 55*b* of each pinching disc 35*c*, finally, defines together with the abutting steps 41 of the pinching discs 35*c* and 35*a* a pivot axis 113 of the pair of pinching discs 35*c*, 35*a* which in projection coincides with the radius 69 on which the second pinching surface 67 of the pinching disc 35*a*** is situated.

The joint action of the pinching discs **35*a*, 35*b* will be discussed below. The joint action of the pinching discs 35*b*, 35*c* and the pinching discs 35*c*, 35*a* takes place in an identical manner. In FIG. 5, the symbols ⓧ on the pinching discs indicate the so-called pressure points in which a line of force interconnecting the points of contact by which the roller members 85 and 91 bear on the stiffening plates 87 and 93 intersects the consecutive pinching discs 35. During rotation of the drive shaft 7, the pinching discs 35 move with their circumferences along the pressure point ⓧ. When the pressure point ⓧ and the cooperating pinching surfaces 67, 63 of the pinching discs 35*a*, 35*b* are on opposite sides of the pivot axis 113, the pinching discs 35*a* and 35*b* are kept at a distance from one another by the stud parts 55*a* of the pinching discs 35*b*. A hair-trapping slot is then present between the cooperating pinching surfaces 67, 63 of each pair of pinching discs 35*a*, 35*b*, between which hairs can enter when the pinching surfaces 67, 63 come near the depilation opening 3 during rotation. The hair-trapping range of the cooperating pinching surfaces 67, 63 of the pinching discs 35*a*, 35*b* is considerably increased during this through the use of the said hair-trapping funnel which is formed by bending of the nose-shaped combs 73 and 71 of the respective pinching discs 35*a* and 35*b* and which precedes the hair-trapping slot seen in the direction of rotation of the pinching discs 35*a*, 35*b***.

The moment the pivot axis 113 of the pinching discs **35*a*, 35*b* has passed the pressure point ⓧ, the pinching discs 35*a*, 35*b* are pivoted about their pivot axis 113 under the influence of the compression means 83. After pivoting about the pivot axis 113, the pinching discs 35*a*, 35*b* are kept temporarily at a distance from one another by the single delaying studs 59 of the pinching discs 35*b*, which are less high than the stud parts 55*b* of the pinching discs 35*a*. Thus a hair-trapping slot of reduced width remains present between the cooperating pinching surfaces 67, 63 of the pinching discs 35*a*, 35*b* after pivoting of the pinching discs 35*a*, 35*b* about the pivot axis 113, which considerably reduces the risk of skin irritation and skin damage. As is shown in FIG. 5, the point of contact of the stud part 55*b* of each pinching disc 35*a* together with the point of contact of the single delaying stud 59 of the adjoining pinching disc 35*b* defines a further pivot axis 115. As soon as this further pivot axis 115 has also passed the pressure point ⓧ, the pinching discs 35*a*, 35*b* will be pivoted about the further pivot axis 115 under the influence of the compression means 83 into the pinching position, in which the cooperating pinching surfaces 67, 63 exert a pinching force on one another near the depilation opening 3. The value of this pinching force reaches a maximum when the radii 69 and 65 of the pinching discs 35*a* and 35*b*, respectively, pass the pressure point ⓧ, after which the pinching force gradually drops again. The pivot axis 113 then again passes the pressure point ⓧ, whereby the pinching discs 35*a*, 35*b* are moved away from one another again. It is noted that the hubs 39 of the pinching discs 35*a* and 35*b* are shifted away from one another in axial direction over a small distance during pivoting of the pinching discs 35*a* and 35*b* about the further pivot axis 115 into the pinching position, so that the steps 41** of the pinching discs 35*a* and 35*b* are not in contact with one another.

It is evident from the above that the single delaying studs 59 of the pinching discs 35*b* act as delaying studs by means of which the pinching position of the pinching discs 35*a*, 35*b* is temporarily put off after pivoting of the pinching discs 35*a*, 35*b* about the pivot axis 113. A hair-trapping slot remains present between the cooperating pinching surfaces 67, 63 of the pinching discs 35*a*, 35*b* in this way during a longer period, while in addition a quicker build-up of the maximum pinching force between the cooperating pinching surfaces 67, 63 is achieved after the pinching position has been reached. The performance of the depilation apparatus can be optimized in the design stage through a favourable choice of the height of the single delaying stud 59 and of the angle between the radius 61 and the radius 65 on which the single delaying stud 59 and the first pinching surface 63, respectively, are situated. This choice depends inter alia on the value of the angle θ indicated in FIG. 3 which the depilation opening 3 encloses around the drive shaft 7 and on the position of the pressure point ⓧ relative to the depilation opening 3. With the pinching discs 35 shown in FIGS. 4*a* and 4*b*, the height of the single stud 59 is approximately half the height of the stud pan 55*a* and the stud pan 55*b*, while the angle between the radii 61 and 65 is approximately 45°.

As was noted above, the pressure point ⓧ lies near the cooperating pinching surfaces 67, 63 in the pinching position of the pinching discs 35*a*, 35*b*. It is apparent from FIG. 5 that the pinching surface 67 of the pinching disc 35*a* is supported during this by the stud pan 55*b* of the bipartite stud 55 of the pinching disc 35*c* adjoining the pinching disc 35*a*, while the pinching surface 63 of the pinching disc 35*b* is supported by the stud pan 55*a* of the bipartite stud 55 of the pinching disc 35*c* adjoining the pinching disc 35*b*. When the pressure point ⓧ lies on the radii 69 and 65 of the cooperating pinching surfaces 67 and 63 and the pinching force between the pinching surfaces 67, 63 reaches a maximum value, a substantially straight force transmission path between the two roller members 85 and 91 of the compression means 83 is created, running substantially parallel to the depilation opening 3, near the depilation opening 3. The pinching force exerted by the cooperating pinching surfaces 67, 63 of the consecutive pairs of pinching discs 35*a*, 35*b* on one another is in that case transmitted through the bipartite studs 55 of the interposed pinching discs 35*c*. This situation is shown in FIG. 2. Owing to the use of the bipartite studs 55 in combination with the stiffening plates 87, 93, only small bending torques occur in the pinching discs 35*a*, 35*b* in the pinching position, so that the elastic deformation of the pinching discs 35*a*, 35*b* is comparatively small. As a result, an optimum value of the pinching force between the pinching discs 35*a*, 35*b* is achieved. Furthermore, the order of magnitude of the compression force exerted by the roller members 85 and 91 on the stiffening plates 87 and 93 is equal to the order of magnitude of the pinching force exerted by the pinching discs 35*a*, 35*b* on one another thanks to the so-called serial force transmission described above. The wear of the roller members 85, 91 and the stiffening plates 87, 93 is comparatively small as a result. The above shows that the two stud pans 55*a* and 55*b* of the bipartite stud 55 of the pinching discs 35*c* each act as a force transmission stud in the situation shown in FIG. 2. The stud pan 55*b* of the pinching discs 35*a*, which together with the mutually facing steps 41 of the pinching discs 35*a* and 35*b* defines the pivot axis 113, at the same time acts as a pivot stud.

The risk of skin irritation and skin damage can be further reduced in that the pinching discs 35 are given a somewhat reduced radius near each nose-shaped comb 71, 73. This reduced radius is indicated with a broken line in FIG. 4*a*. Owing to the radius reduction, the nose-shaped combs 71 and 73 remain some small distance away from the skin during tilting of the pinching discs 35*a*, 35*b* about the pivot axis 113 because the pinching discs 35*c* rest on the skin then. Thus it is counteracted that the skin is pinched between the nose-shaped combs 71 and 73 i.e., pinching of the skin is avoided.

Furthermore, the catching probability for comparatively short hairs can be further increased in that the pinching discs 35 are given a somewhat increased radius near each pinching surface 63, 67. This increased radius is also indicated with a broken line in FIG. 4*a*.

The joint action of the pinching discs 35*a* and 35*b* was described above. The joint action of the pinching discs 35*b* and 35*c* and of the pinching discs 35*c* and 35*a* takes place in an identical manner, the tilting movements of the pairs of pinching discs 35*a*, 35*b*, the pairs of pinching discs 35*b*, 35*c*, and the pairs of pinching discs 35*c*, 35*a* taking place each time with mutual interspacings which correspond to a rotation of the drive shaft 7 through 120°. Starting from the situation shown in FIG. 2, the pinching discs 35*b* and 35*c* accordingly reach the pinching position after the drive shaft 7 has rotated 120° further, in which case the cooperating pinching surfaces 67, 63 of the pinching discs 35*b*, 35*c* are supported on either side by the bipartite studs 55 of the interposed pinching discs 35*a*. After this, after the drive shaft has again rotated through 120°, the pinching discs 35*c* and 35*a* enter the pinching position, in which the cooperating pinching surfaces 67, 63 of the pinching discs 35*c*, 35*a* are supported on either side by the bipartite studs 55 of the interposed pinching discs 35*b*. Thus the use of the angle of 120° between the consecutive pinching discs 35 provides an even operation of the depilation apparatus.

It is furthermore apparent from FIG. 2 that the distance between the two outermost pinching discs 35*a* is smaller near the depilation opening 3 than at the side of the drive shaft 7 facing away from the depilation opening 3. This difference in distance is caused by the pivoting motion of the pinching discs 35*a*, 35*b*. Through the use of the angle of 120°, the pinching discs 35*a*, 35*b*, when in the pinching position, are bounded on either side by a pinching disc 35*c* which is not in the pinching position. As a result, the said difference in distance remains limited, so that also the maximum angle through which the two outermost pinching discs 35*a* are pivoted relative to the drive shaft 7 remains limited. Furthermore, the distance between the two outermost pinching discs 35*a* during one revolution of the drive shaft 7 will fluctuate slightly. In the position of the drive shaft 7 shown in FIG. 2, where the pinching discs 35*a*, 35*b* are in the pinching position, the pinching discs 35*b* and 35*c* as well as the pinching discs 35*c* and 35*a* are kept at a distance from one another by the bipartite studs 55 of the pinching discs 35*c*, the distance between the two outermost pinching discs 35*a* being at its maximum. A similar situation occurs in a position of the drive shaft 7 in which the pinching discs 35*b*, 35*c* or the pinching discs 35*c*, 35*a* are in the pinching position. In the intermediate positions of the drive shaft 7 there are no bipartite studs 55 near the depilation opening 3, so that the pinching discs 35 are pressed further together near the depilation opening 3 by the compression member 83. To prevent the pinching discs 35 being pressed together too far, whereby an unnecessary wear of the compression means 83 and of the two stiffening plates 87 and 83 and an unnecessary power consumption of the drive motor 33 would occur, the housing 1 is provided with the adjustment bolt 109 referred to above, whose head 111 serves as a stop for the pressure head 95. Owing to the use of the said stop, the roller members 85 and 91 do not exert a compression force on the stiffening plates 87 and 93 in the said intermediate positions of the drive shaft 7.

Figure 6:
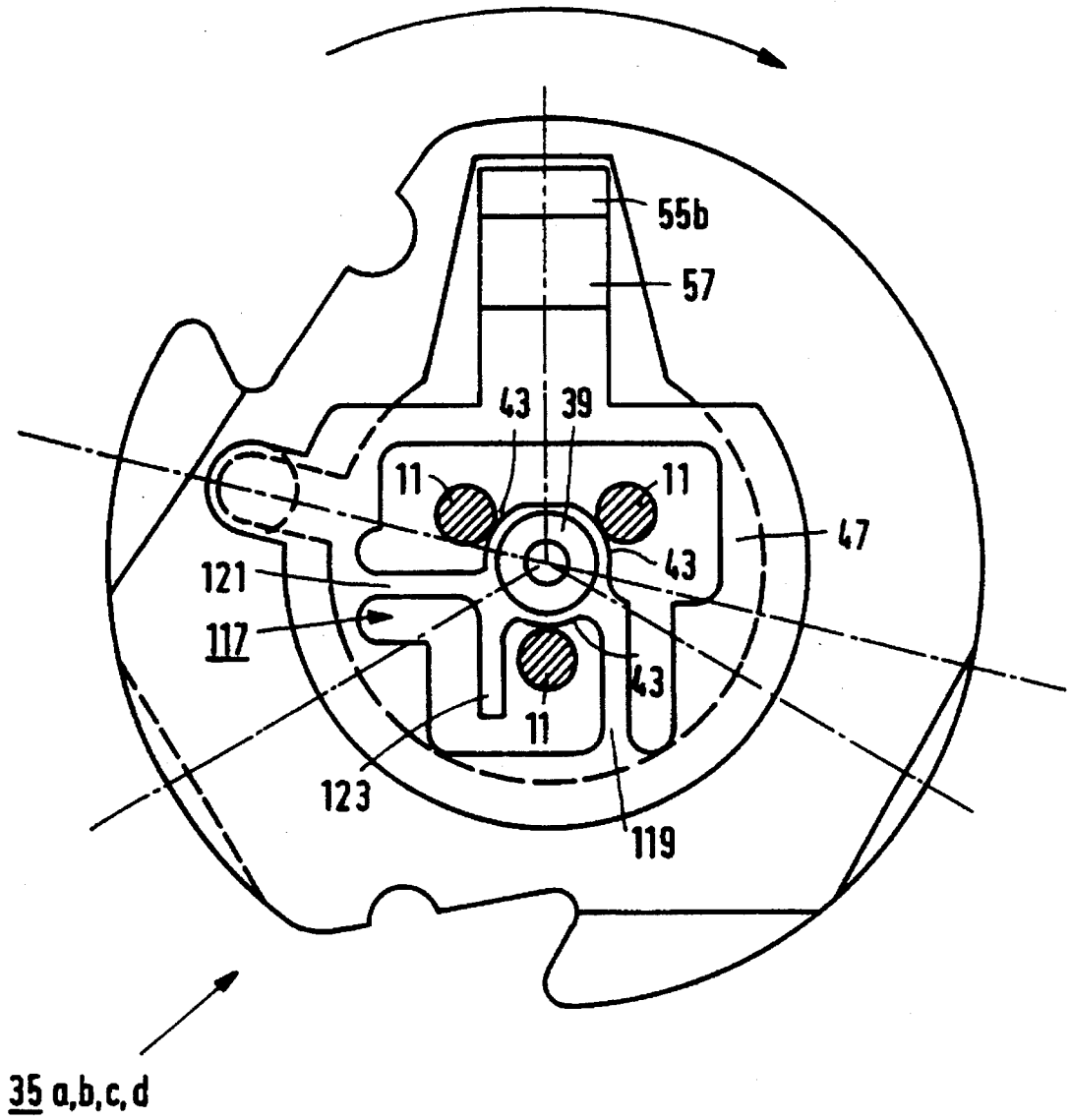
FIG. 6 shows a second embodiment of a pinching disc of the depilation head of FIG. 2, and FIGS. 7*a* to 7*f* show a few alternative embodiments of a pinching disc of the depilation head of FIG. 2.

As was discussed above, each bipartite stud 55 is coupled to the associated pinching disc 35 through a flexible strip 51, so that the bipartite stud 55 is displaceable relative to the pinching disc 35 over a limited distance in a direction transverse to the plane of the pinching disc 35 and can be twisted through a limited angle about the radius 57 of the pinching disc 35. It is achieved in this way that the bipartite stud 55 has some freedom of movement relative to the associated pinching disc 35 when the bipartite stud 55 is clamped between the pinching surfaces 63, 67 of the two adjoining pinching discs 35 near the depilation opening 3. Shifting of the bipartite stud 55 over the relevant pinching surfaces 63, 67 and a resulting wear of the bipartite stud 55 is thus prevented as much as possible. This shifting could occur inter alia as a result of differences in tilting speed between the consecutive pinching discs 35. In the second embodiment of the pinching discs 35 shown in FIG. 6, the freedom of movement of the bipartite stud 55 relative to the adjoining pinching discs 35 is further increased through the use of an elastically deformable coupling member 117 by means of which the hub 39 is coupled to the core disc 47. The coupling member 117, which is integrated with the core disc 47 into one injection-moulded, synthetic-resin pan, comprises a first flexible spoke 119 which extends parallel to the radius 57 of the bipartite stud 55 and a second flexible spoke 121 which extends transverse to the first spoke 119. Just as in the first embodiment of the pinching disc 35 depicted in FIG. 4*a*, the hub 39 is enclosed between the three rods 11 of the drive shaft 7 in a radial direction relative to the centerline 9 by means of spherical lateral surfaces 43. The hub 39 is provided with a pawl 123 directed parallel to the first spoke 119, the first spoke 119 and the pawl 123 being situated at equal distances from the radius 57. The pinching disc 35 is coupled to the drive shaft 7 so as to rotate along with it by means of the pawl 123, one of the three rods 11 of the drive shaft 7 being accommodated with clearance between the pawl 123 and the first spoke 119. Owing to the use of the flexible spokes 119 and 121, of which the spoke 119 is arranged at a distance from the radius 57 of the bipartite stud 55, the hub 39 is displaceable along the radius 57 over small distances under elastic deformation of the two spokes 119 and 121. Thus the bipartite stud 55 with the pinching disc 35 is displaceable over small distances in a radial direction relative to the drive shaft 7, so that in the pinching position of the adjoining pinching discs 35 a radial shift of the bipartite stud 55 along the pinching surfaces 63, 67 of the adjoining pinching discs 35 is prevented.

It is noted that in both embodiments of the pinching discs 35 described above the hub 39 is constructed as a pivot stud. The force transmission studs, however, may also be used in a depilation apparatus in which the pairs of pinching discs are each tiltable about two diametrically opposed pivot studs and in which the hubs of the pinching discs do not mutually abut. In this alternative embodiment of the pinching discs, however, an additional stud is necessary, which leads to a somewhat more complicated construction of the pinching discs.

Figure 7A:
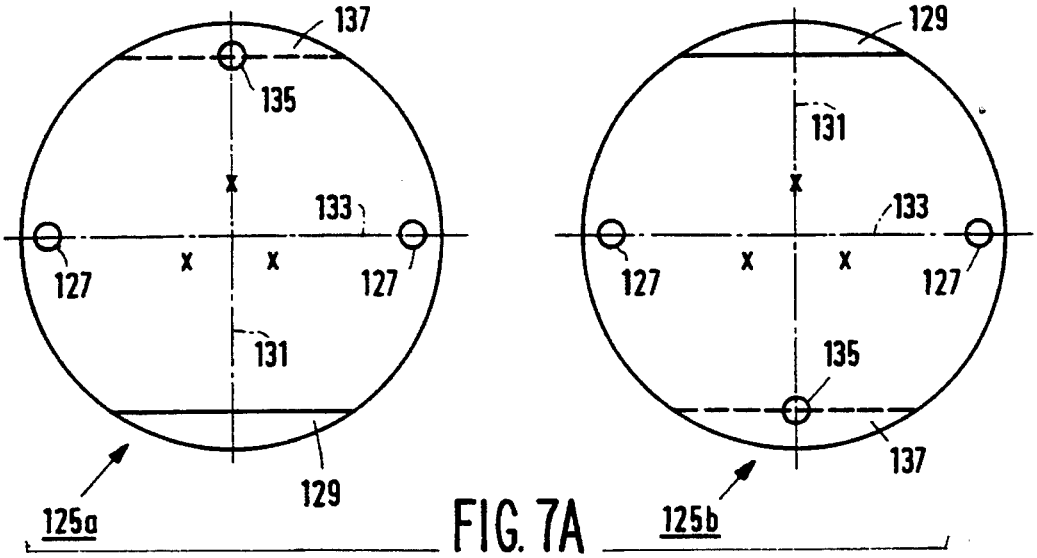
Figure 7B:
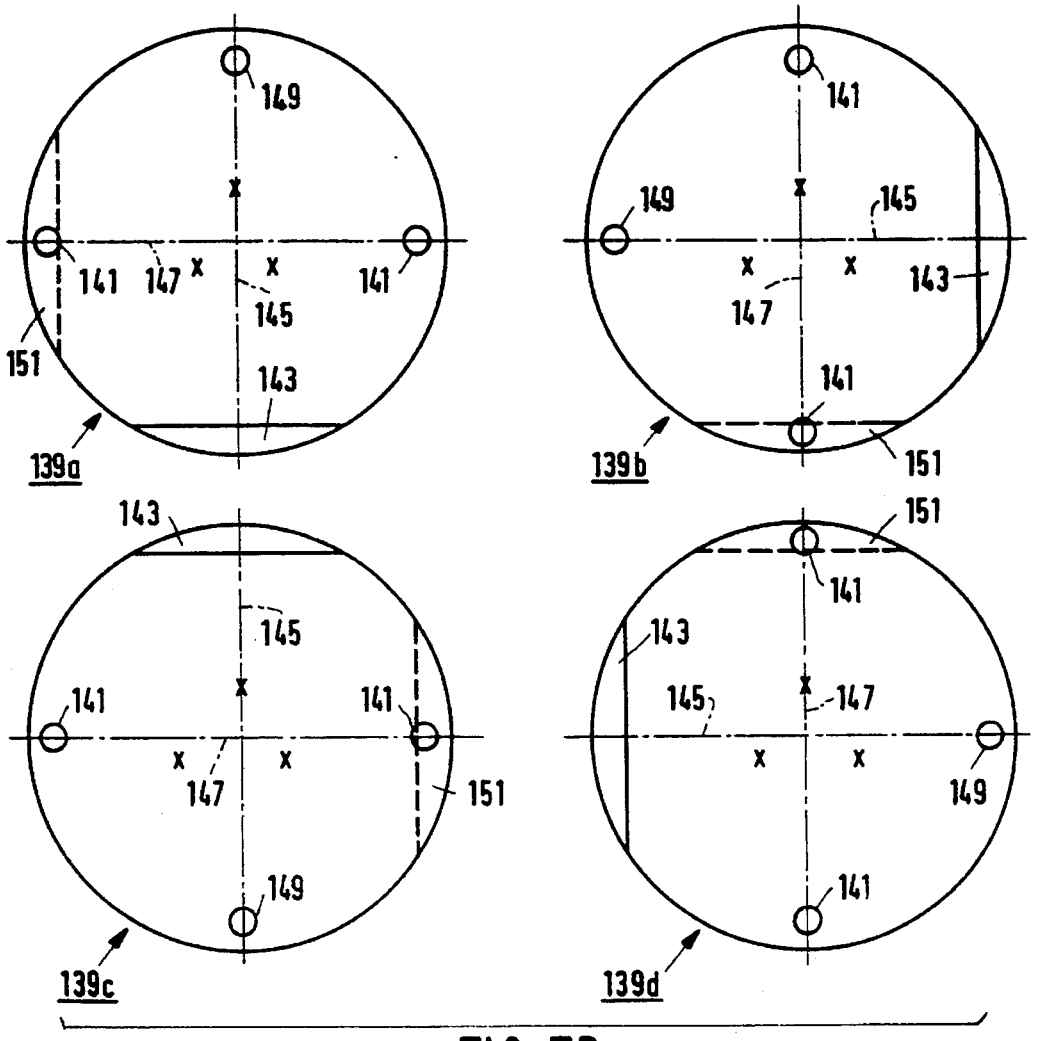

It is further noted that the angle through which the consecutive pinching discs are mutually rotated about the drive shaft, and which is equal to the angle enclosed by the radii of the two pinching surfaces, may also have a value other than 120°. FIG. 7*a* shows two consecutive pinching discs 125*a*, 125*b* of an alternative embodiment of the depilation apparatus in which the pinching discs 125 are coupled to the drive shaft in positions which are mutually rotated through 180° about the drive shaft. The pinching discs 125 have on one of the two lateral surfaces two diametrically opposed pivot studs 127, a first pinching surface 129 whose centerline 131 encloses an angle of 90° with the pivot axis 133, and a force transmission stud 135 which is arranged diametrically opposite the first pinching surface 129. A second pinching surface 137 is present on the other lateral surface of the pinching discs 125 near the force transmission stud 135. In this alternative embodiment, all pinching discs 125 are simultaneously in the pinching position, so that the two outermost pinching discs 125 should be tilted through a comparatively wide angle relative to the drive shaft. FIG. 7*b* furthermore shows four consecutive pinching discs 139*a*, 139*b*, 139*c* and 139*d* of a depilation apparatus in which the pinching discs 139 are coupled to the drive shaft in positions which are mutually rotated through 90°. The pinching discs 139 are provided on one of their two lateral surfaces with two diametrically opposed pivot studs 141 which each also act as a force transmission stud, a first pinching surface 143 whose centerline 145 encloses an angle of 90° with the pivot axis 147, and a force transmission stud 149 which is positioned diametrically opposite the first pinching surface 143. A second pinching surface 151 is present on the other lateral surface of the pinching discs 139 near one of the pivot studs 141. In this embodiment, there are two pinching discs 139 which are not in the pinching position between every two consecutive pairs of pinching discs 139 which are in the pinching position, so that only a comparatively small compression of the set of pinching discs 139 takes place near the depilation opening. In the pinching position, the pinching surfaces 143 are each supported by a pivot stud 141 of the adjoining pinching disc 139, while the pinching surfaces 151 are each supported by the adjacent pivot stud 141 of the pinching disc 139 of which the pinching surface 151 forms part. Between the supporting pivot studs 141 there is a force transmission stud 149 of an interposed pinching disc 139 each time. When a drive shaft having three parallel rods is used, however, four different pinching discs 139*a*, 139*b*, 139*c*, 139*d* are required in this embodiment.

Figure 7C:
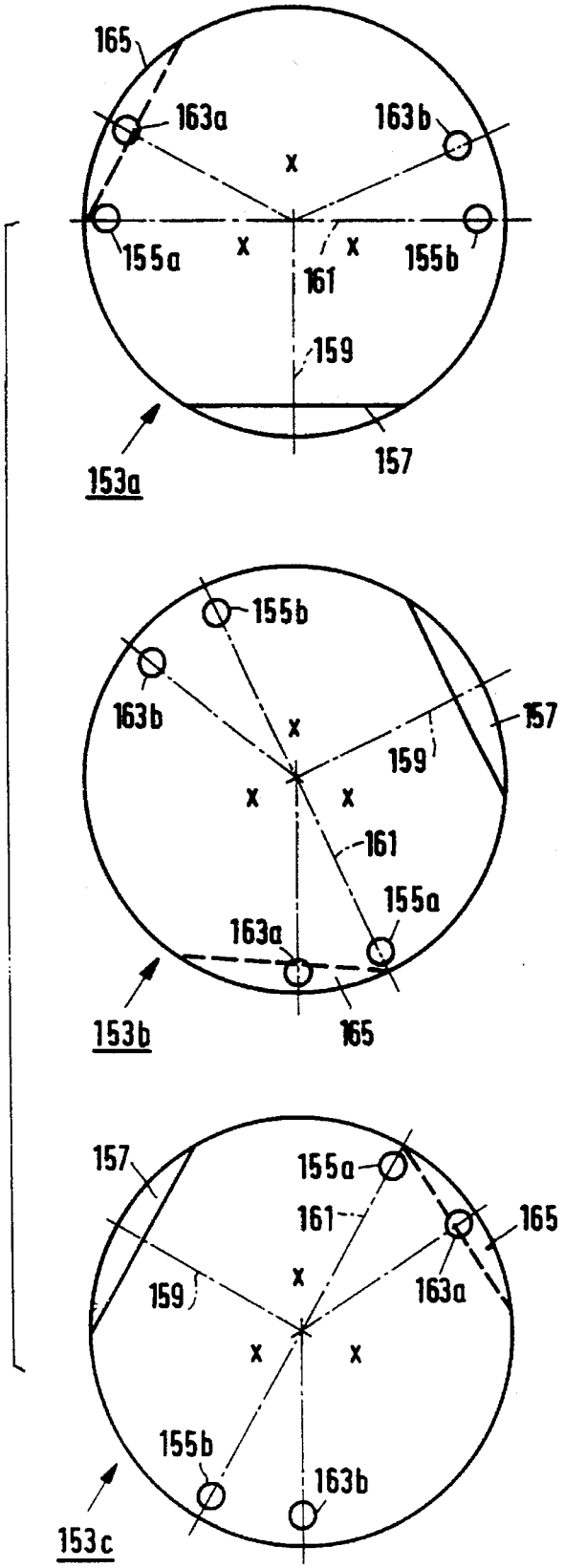

Finally, it is noted that the angles enclosed by the radii on which the pinching surfaces are situated with the pivot axis may also have a value other than 60°. FIG. 7*c* shows three consecutive pinching discs 153*a*, 153*b*, 153*c* of an alternative embodiment of the depilation apparatus in which the pinching discs 153 are mutually rotated through 120° about the drive shaft. The pinching discs 153 each comprise two diametrically opposed pivot studs 155*a*, 155*b* on one of the two lateral surfaces, a first pinching surface 157 situated on a radius 159 which encloses an angle of 90° with the pivot axis 161, and two force transmission studs 163*a*, 163*b* which are each positioned on a radius which encloses an angle of 120° with the radius 159. On the other lateral surface, the pinching disc 153 is provided with a second pinching surface 165 near one of the two force transmission studs 153. A disadvantage of the pinching discs 153 is that the maximum value of the pinching force between the cooperating pinching surfaces 157, 165 of two adjoining pinching discs 153 after pivoting of the relevant pinching discs 153 into the pinching position is not reached until after the drive shaft has been rotated through a further 90°. The build-up of the pinching force may be speeded up through the use of an angle of 60° between the radius 159 and the pivot axis 161

Figure 7D:
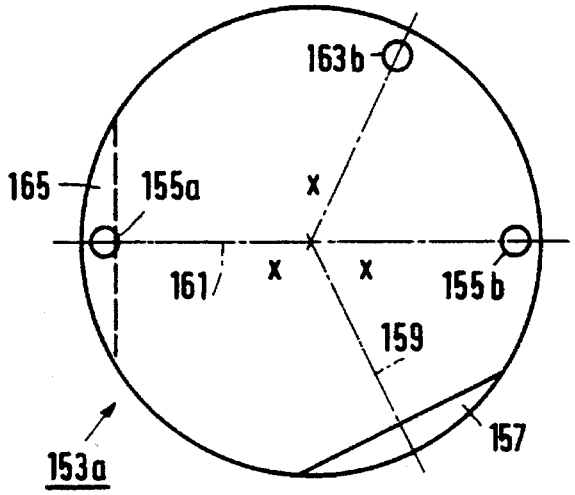
Figure 7E:
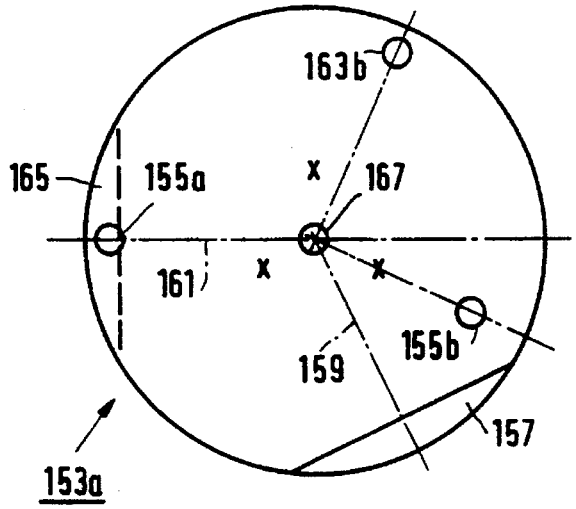
Figure 7F:
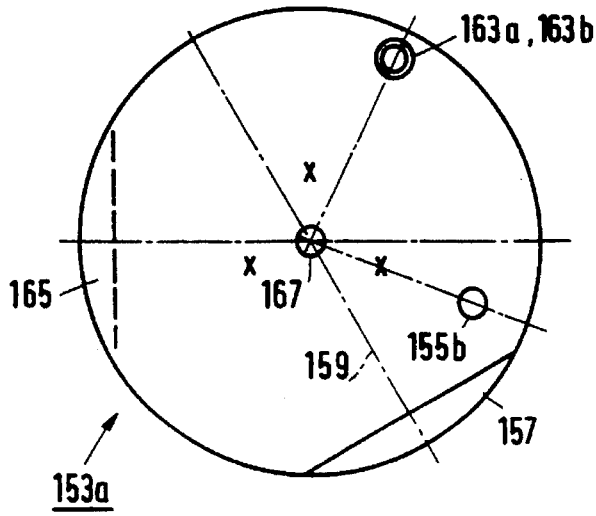

(see FIG. 7*d*). In this case the force transmission stud 163*a* is dispensed with and the pivot stud 155*a* also acts as a force transmission stud. The build-up of the pinching force may be further speeded up in that the hub 167 of the pinching disc 153 is used as a pivot stud instead of the pivot stud 155*b*. The pivot stud 155*b* may then be dispensed with or may be used as a delaying stud. In the latter case, the pivot stud 155*b* should be reduced in height and be moved further towards the pinching surface 157 (see FIG. 7*e*). Starting from the construction of the pinching discs 153 depicted in FIG. 7*e*, finally, the first embodiment of the pinching discs 35 according to FIG. 4*a* is obtained in that the integrated pivot and force transmission stud 155*a* of each pinching disc 153 is transferred to the lateral surface of the adjoining pinching disc 153, whereby a bipartite stud 163*a*, 163*b* is created on each pinching disc 153 (see FIG. 7*f*).

We claim:

1. A depilation apparatus with pinching discs which are coupled to a drive shaft which is rotatable relative to a housing and extends parallel to a depilation opening of the housing, the apparatus comprising two outermost pinching discs and a plurality of inner pinching discs, each pinching disc being pivotable under the influence of a compression means about a pivot axis directed transverse to the drive shaft into a pinching position in which a pinching surface of said pinching disc and a pinching surface of an adjoining pinching disc exert a pinching force on one another near the depilation opening, wherein said pivot axis is determined by two pivot studs which are provided on at least one of mutually facing lateral surfaces of said pinching disc and said adjoining pinching disc, and wherein each inner pinching disc which is in the pinching position in conjunction with one of its two adjoining pinching discs is supported near its pinching surface by the other of said two adjoining pinching discs by means of a force transmission stud.

2. A depilation apparatus as claimed in claim 1, wherein the two outermost pinching discs are each provided with a stiffening plate at a lateral surface facing away from an adjoining inner pinching disc, the compression means exerting a compression force directed substantially parallel to the drive shaft on each of the two stiffening plates near the depilation opening.

3. A depilation apparatus as claimed in claim 2, in which the compression means is provided with a first and a second roller member each of which lies against one of the two stiffening plates near the depilation opening, wherein the first roller member has rotation bearings in the housing while the second roller member has rotation bearings in a pressure head which is movable relative to the housing substantially parallel to the drive shaft under spring pressure of a mechanical spring fastened between the pressure head and the housing.

4. A depilation apparatus as claimed in claim 3, wherein the housing is provided with a stop for the pressure head by means of which a minimum interspacing between the two roller members is defined.

5. A depilation apparatus as claimed in claim 4 wherein each inner pinching disc situated between two adjoining pinching discs has two lateral surfaces and is provided on each lateral surface with only one pinching surface and with a force transmission stud, the two pinching surfaces being situated on centerlines of each inner pinching disc which enclose an angle of substantially 120° with one another, and the two each inner force transmission studs being each on a centerline which encloses an angle of substantially 120° with a centerline of a respective pinching surface, the pinching discs being coupled to the drive shaft in consecutive positions which are rotated about the drive shaft through mutual angles of 120°.

6. A depilation apparatus as claimed in claim 3 wherein each inner pinching disc situated between two adjoining pinching discs has two lateral surfaces and is provided on each lateral surface with only one pinching surface and with a force transmission stud, the two pinching surfaces being situated on centerlines of each inner pinching disc which enclose an angle of substantially 120° with one another, and the two force transmission studs which are each on a centerline which encloses an angle of substantially 120° with a centerline of a respective pinching surface, the pinching discs being coupled to the drive shaft in consecutive positions which are rotated about the drive shaft through mutual angles of 120°.

7. A depilation apparatus as claimed in claim 2 wherein each inner pinching disc situated between two adjoining pinching discs has two lateral surfaces and is provided on each lateral surface with only one pinching surface and with a force transmission stud, the two pinching surfaces being situated on centerlines of each inner of the pinching disc which enclose an angle of substantially 120° with one another, and the two force transmission studs being each on a centerline which encloses an angle of substantially 120° with a centerline of a respective pinching surface, the pinching discs being coupled to the drive shaft in consecutive positions which are rotated about the drive shaft through mutual angles of 120°.

8. A depilation apparatus as claimed in claim 1, wherein each inner pinching disc situated between two adjoining pinching discs has two lateral surfaces and is provided on each lateral surface with only one pinching surface, while each inner pinching disc is provided with two force transmission, studs, the pinching discs being coupled to the drive shaft in consecutive positions which are rotated about the drive shaft through mutual angles of 120°.

9. A depilation apparatus as claimed in claim 8, wherein cooperating pinching surfaces of each pair of adjoining inner pinching discs are present on a centerline which encloses an angle of substantially 60° with the pivot axis of the pair, one of the two force transmission studs of each inner pinching disc being integral with one of the two pivot studs of each inner pinching disc.

10. A depilation apparatus as claimed in claim 8, wherein the two force transmission studs are each situated on a respective lateral surface of each inner pinching disc.

11. A depilation apparatus as claimed in claim 10, wherein the two force transmission studs are integrated so as to form a bipartite stud which is provided in a stud window of each inner pinching disc.

12. A depilation apparatus as claimed in claim 5, wherein the bipartite stud is fastened to each inner pinching disc by means of a flexible strip which extends in a radial direction relative to a center of each inner pinching disc in the stud window of each inner pinching disc.

13. A depilation apparatus as claimed in claim 9 a respective lateral surface of each inner pinching disc has two force transmission studs situated on a joint centerline which encloses an angle of substantially 120° with a centerline of each of the two pinching surfaces.

14. A depilation apparatus as claimed in claim 8, wherein each inner pinching disc situated between two adjoining pinching discs is provided with two recesses, each recess being provided in front of a respective pinching surface of said two pinching surfaces of each pinching disc seen in a direction of rotation of each inner pinching disc, while a portion of each pinching surface adjoining the said recess is constructed as a nose-shaped comb.

15. A depilation apparatus as claimed in claim 14, wherein the nose-shaped combs of the cooperating pinching surfaces of each pair of adjoining inner pinching discs are bent so as to form a hair-trapping funnel.

16. A depilation apparatus as claimed in claim 15 wherein the pinching discs have a radius of reduced size near each nose-shaped comb.

17. A depilation apparatus as claimed in claim 15 wherein the pinching discs have an increased radius near each pinching surface.

18. A depilation apparatus as claimed in claim 14, wherein the pinching discs have a radius of reduced size near each nose-shaped comb.

19. A depilation apparatus as claimed in claim 18 wherein the pinching discs have an increased radius near each pinching surface.

20. A depilation apparatus as claimed in claim 14, wherein the pinching discs have a radius of increased size near each pinching surface.

21. A depilation apparatus as claimed in claim 1 wherein each pivot stud is a hub and each inner pinching disc positioned between two other pinching discs is coupled to the drive shaft by means of said hub which is fastened to each inner pinching disc via an elastically deformable coupling member.

22. A depilation apparatus as claimed in claim 21, wherein the coupling member comprises two flexible spokes which extend transversely to one another in a central window of each inner pinching disc.

23. A depilation apparatus as claimed in claim 1 wherein one of the two pivot studs of at least one of the inner pinching discs is formed by a hub positioned near a center of the at least one inner pinching disc, with which hub the at least one inner pinching disc is coupled to the drive shaft and bears on an adjoining inner pinching disc.

24. A depilation apparatus as claimed in claim 23, wherein one of the lateral surfaces of each disc of the pair of adjoining inner pinching discs is provided with a delaying stud which is situated on a centerline which encloses an angle smaller than 60° with a centerline on which the cooperating pinching surfaces of the pair are present.

* * * * *